US006244158B1

(12) United States Patent
Roche

(10) Patent No.: US 6,244,158 B1
(45) Date of Patent: Jun. 12, 2001

(54) OPEN CENTER HYDRAULIC SYSTEM WITH REDUCED INTERACTION BETWEEN BRANCHES

(75) Inventor: Richard M. Roche, Gresham, OR (US)

(73) Assignee: FPS, Inc., Portland, OR (US)

( * ) Notice: Subject to any disclaimer, the term of this patent is extended or adjusted under 35 U.S.C. 154(b) by 0 days.

(21) Appl. No.: 09/225,279

(22) Filed: Jan. 5, 1999

Related U.S. Application Data

(60) Provisional application No. 60/070,509, filed on Jan. 6, 1998.

(51) Int. Cl.[7] ..... F15B 11/08

(52) U.S. Cl. ..... 91/446; 91/447

(58) Field of Search ..... 60/422, 466; 91/433, 91/446, 447, 453, 443, 463

(56) References Cited

U.S. PATENT DOCUMENTS

| | | | | |
|---|---|---|---|---|
| 3,234,957 | | 2/1966 | Allen . | |
| 3,771,558 | | 11/1973 | Ailshie . | |
| 3,970,108 | | 7/1976 | Ailshie . | |
| 4,139,021 | | 2/1979 | Ailshie et al. . | |
| 4,178,962 | | 12/1979 | Tennis . | |
| 4,470,260 | | 9/1984 | Miller et al. . | |
| 4,781,219 | | 11/1988 | Haarstad et al. . | |
| 4,958,493 | | 9/1990 | Schutten et al. . | |
| 5,197,284 | * | 3/1993 | Cartner | 60/466 |
| 5,259,192 | * | 11/1993 | Karakama et al. | 60/422 |
| 5,873,244 | * | 2/1999 | Cobo et al. | 60/422 |

* cited by examiner

*Primary Examiner*—Christopher Verdier
*Assistant Examiner*—Thomas E. Lazo
(74) *Attorney, Agent, or Firm*—Eugene Stephens & Associates; Thomas B. Ryan

(57) ABSTRACT

Directional control valves are arranged with restrictable center passageways connected in series to a fixed displacement pump and with restrictable power and exhaust passageways straddling loads connected in parallel to the same fixed displacement pump. Pressure responsive valves located between the loads and the restrictable exhaust passageways reduce interactions between the loads. Another pressure responsive valve located between the fixed displacement pump and the restrictable center passageways maintains an appropriate division of flow between the restrictable center passageways and the restrictable power and exhaust passageways.

36 Claims, 3 Drawing Sheets

OPEN CENTER HYDRAULIC SYSTEM WITH REDUCED INTERACTION BETWEEN BRANCHES

This application claims the benefit of U.S. Provisional Application No. 60/070,509, filed on Jan. 6, 1998, which provisional application is incorporated by reference herein.

TECHNICAL FIELD

The invention relates to open center hydraulic systems, which are generally noted for ruggedness, simplicity, low cost, tolerance of dirt, and ease of service.

BACKGROUND

Open center hydraulic systems generally comprise a fluid power source, such as a fixed displacement pump, having a low-pressure side and a high-pressure side. A reservoir is connected to the low-pressure side to supply the fixed displacement pump with fluid. One or more loads, such as hydraulic cylinders or motors, regulated by open center directional control valves are connected to the high-pressure side to utilize the fluid power generated by the fixed displacement pump. The fluid flow path is from the fixed displacement pump, which draws fluid from the reservoir through any one or more of the open center directional control valves and their associated loads before returning to the reservoir.

The open center directional control valves are typically spool valves having one normally open orifice ($NO_1$) in parallel with a pair of normally closed orifices ($NC_2$ and $NC_3$) that straddle a load. Two directions of flow control through the load (e.g., forward and reverse) require a second pair of normally closed orifices ($NC_4$ and $NC_5$). A common spool regulates flow through all of the orifices. One direction of spool movement gradually closes the normally open orifice $NO_1$ of a center core passage and gradually opens the normally closed orifice $NC_2$ of a power core passage as well as the normally closed orifice $NC_3$ of an exhaust core passage. An opposite direction of spool movement also gradually closes the normally open orifice $NO_1$ of the center core passage while gradually opening the normally closed orifice $NC_4$ of another power core passage and the normally closed orifice $NC_5$ of another exhaust core passage. Additional open center spool valves for controlling other loads can be arranged as individual valves or multiple valve sections that are stacked or sandwiched together as a single unit.

The valve spool usually contains longitudinal machined or pressed slots called metering notches which provide for a more gradual opening or closing of the spool orifices. Many different styles of metering notches are incorporated by manufacturers in order to achieve gradual flow control, especially at low flow rates. Some valve spools have metering notches in communication with the normally open orifice $NO_1$ as well as both normally closed orifices $NC_2$ and $NC_3$, and others have metering notches only in communication with the normally open orifice $NO_1$ of the center core passage and the normally closed orifices $NC_3$ of the exhaust core orifice. The degree of spool valve overlap also varies from manufacturer to manufacturer.

Each load is connected to a separate branch line controlled by one of the spool valves. With all of the spool valves in the neutral or off position, fluid flows virtually unrestricted from the fixed displacement pump through the normally open orifices $NO_1$ of the center core passages and back to the reservoir. Shifting the directional valves from neutral toward one direction or the other gradually restricts flows through the normally open orifices $NO_1$ of the central core passages and pressurizes the power core passages. Further spool movement gradually opens the normally closed orifices $NC_2$ or $NC_4$ of the power core passages permitting flows to the loads (e.g., cylinders or motors). Return flows from the loads encounter the normally closed orifices $NC_3$ and $NC_5$ of the exhaust core passages, which are also gradually opened by yet further movement of the spool to allow return flows to the reservoir. Since the normally closed orifices $NC_3$ and $NC_5$ of the exhaust core passages provide the final restriction of flows returning from the loads to the reservoir, these orifices ($NC_3$ and $NC_5$) are primarily responsible for regulating the operating speeds of the loads.

The central core passages of the multiple spool valves are connected in series to the fixed displacement pump, while each of the power core passages of the same spool valves are connected in parallel to the fixed displacement pump. Thus, closing any one of the normally open orifices $NO_1$ in series creates the potential for pressure in all of the power core passages, including the power core passage whose normally closed orifice $NC_2$ or $NC_4$ is gradually opened by further movement of the same spool valve.

At any given setting combination of the spool valves, the pressure in the power core passages, which is substantially equivalent to the output pressure of the fixed displacement pump (i.e., the system pressure), varies as a function of the total flow resistance in the load branches. For example, a maximum system pressure occurs at a given setting combination of the spool valves when the load flow resistance is high enough to force all of the fixed amount of flow from the pump through the normally open orifices $NO_1$ of the center core passages to the reservoir. Any flow through the load branches (i.e., through either pair of normally closed orifices $NC_2$, $NC_3$ or $NC_4$, $NC_5$ of the power and exhaust core passages) to the reservoir reduces the potential system pressure from this maximum for the given valve setting combination. A minimum system pressure occurs at the same valve setting combination when the load flow resistance in the load branches is also at a minimum, permitting a maximum flow through the load branches to the reservoir. Predetermined flow rates cannot be established for any given setting of the individual spool valves; because variations in the load flow resistance alters system pressure, which affects the total amount of flow through the branch lines. System pressure and the resulting flow through the branch lines are also affected by variations in the valve settings.

In addition, when two or more spool valves are operated simultaneously, the flow rate through any one load branch can be affected by variations in the load flow resistance of another load branch. At a given system pressure, the load branch exhibiting the relatively decreased load resistance will receive more flow unless its spool valve is returned toward a more neutral position (i.e., "throttled back"). These instabilities make open center hydraulic systems difficult to control. Operators of open center systems often complain of a lack of fine metering control and high forces at valve control levers that further interfere with operator control and contribute to operator fatigue.

Attempts have been made to improve the flow control characteristics of open center valves by reducing variations in the bypass flow rate. See, for example, U.S. Pat. No. 4,139,021 to Ailshie et al. and U.S. Pat. No. 4,178,962 to Tennis. However, neither of these patents address the problem of flow instability caused by concurrently operating loads.

SUMMARY OF INVENTION

My invention reduces flow instabilities caused by interactions among concurrent loads in different load branches as well as load variations within individual branches of open center systems. A mechanism, which can be referred to as "meter-out pressure compensation" is used to relate directional control valve positions to more stable flow rates through the load branches. Another mechanism referred to as "bypass pressure compensation" can be used to supplement and further enhance the meter-out pressure compensation.

According to one embodiment, the open center system includes the usual features of a reservoir, a fixed displacement pump, and a plurality of directional control valves that direct flow between a plurality of load branches and a bypass line to the reservoir. Each load branch is also connected to the reservoir. The directional control valves are preferably spool valves each having a normally open orifice $NO_1$ along a center core passage, at least one pair of normally closed orifices $NC_2$ and $NC_3$ along respective power core and exhaust core passages that straddle a load, and a common spool that is movable for adjusting the sizes of the three orifices $NO_1$, $NC_2$, and $NC_3$. The center core passages of the spool valves are arranged in series along the bypass line between the fixed displacement pump and the reservoir, and the power core and exhaust core passages of each spool valve are together arranged in parallel with the power core and exhaust core passages of the other spool valves between the fixed displacement pump and the reservoir.

To reduce flow instabilities in accordance with my invention, each of the load branches is fitted with a branch pressure reducing valve between the load and the normally closed orifice $NC_3$ of the exhaust core passage. Sensing lines of the branch pressure reducing valve straddle the normally closed orifice $NC_3$ and work in connection with an adjustable bias to progressively close the branch pressure reducing valve above a setpoint differential pressure.

The objective is to maintain a constant pressure across the normally closed orifice $NC_3$ of the exhaust core passage so that any one position of the spool commands a constant flow rate from the load to the reservoir regardless of variations in system pressure or load flow resistance variation. An increasing pressure differential across the normally closed orifice $NC_3$ above the setpoint closes the branch pressure reducing valve to prevent an unwanted increase in flow through the normally closed orifice $NC_3$. A decreasing pressure differential across the normally closed orifice $NC_3$ below the setpoint opens the branch pressure reducing valve to prevent an unwanted decrease in flow through the normally closed orifice $NC_3$.

The constant pressure differential across the normally closed orifice $NC_3$ is preferably maintained throughout most of the range of spool valve positions to hold the upstream load at a constant speed regardless of its flow resistance, the flow resistance of loads in other branches, or other effects on the output pressure of the fixed displacement pump. However, at spool valve positions approaching "full throttle" (i.e., wide open settings of the normally closed valves $NC_2$ and $NC_3$), the branch pressure reducing valve preferably has little or no effect on the load speed. A control orifice of the branch pressure reducing valve is sized so that at its wide open setting, little or no restriction to flow is exhibited. Thus, the branch pressure reducing valve preferably supports fine speed control at slow to moderate load speeds, where such control is most needed, yet permits full flow at higher load speeds to maintain a full range of possible load speeds.

A proper setting of the setpoint differential pressure is important to achieving the desired operation of the branch pressure reducing valve. Too high a setpoint differential pressure renders the branch pressure reducing valve ineffective throughout most, if not all, of the range of fluid flow rates through the affected load branch. Too low a setpoint differential pressure can limit the range of fluid flow rates (i.e., limit the maximum load speed) and can produce excessive back pressure in the system, which reduces efficiency. Thus, the branch pressure reducing valve is preferably limited to restricting flow to only when the normally closed orifice $NC_3$ of the exhaust core passage is also restricting flow to regulate load speed within a range less than its maximum speed at full flow.

The branch pressure reducing valves most effectively compensate for momentary load flow resistance decreases, because the branch pressure reducing valves are designed to restrict excess flows through the normally closed orifices $NC_3$. Momentary increases in load flow resistance can temporarily reduce exhaust flows from the loads, resulting in insufficient flows through the normally closed orifices $NC_3$. Accordingly, another embodiment of my invention provides an additional bypass pressure reducing valve located along the bypass line just upstream of the normally open orifices $NO_1$. Sensing lines of the bypass pressure reducing valve straddle the series of normally open orifices $NO_1$ and work in connection with an adjustable bias to progressively close the bypass pressure reducing valve above a setpoint differential pressure.

The objective of the bypass pressure reducing valve is to prevent variations in the total flow resistance of the load branches from affecting the division of flow between the bypass line and the multiple load branches. The constant pressure drop across the series of normally open orifices $NO_1$ equates individual positions of the spool valves to fixed amounts of flow through the bypass line to the reservoir. Since the output flow of the pump is fixed, a fixed amount of remaining flow is also forced through the load branches.

The setpoint differential pressure of the bypass pressure reducing valve is also preferably set in relation to the characteristic pressure profile of the system to cover a range of normal operations. Set too low, the bypass pressure reducing valve wastes energy. Set too high, the bypass pressure reducing valve has too little effect on flows through the bypass line.

The bypass pressure reducing valve enhances the performance of the branch pressure reducing valves in two main respects. First, a momentary increase in the total flow resistance of the load branches, which would normally force a larger percentage of the flow through the bypass line and reduce the combined flow through the load branches, is balanced by an additional restriction in the bypass line to maintain the same level of flow through the load branches. This assures adequate flow through the normally closed orifices $NC_3$ so that the branch pressure reducing valves can continue to carry out their meter-out pressure compensating function.

Second, a momentary decrease in the total flow resistance to the load branches, which would normally force a smaller percentage of the flow through the bypass line and increase the combined flow through the load branches, is balanced by a reduced restriction in the bypass line to maintain the same level of flow through the branches. This reduces the amount of restriction and resulting back pressure against the loads required of the branch pressure reducing valves to maintain the desired flow rates through the normally closed orifices $NC_3$. With the addition of the bypass pressure reducing valve, the main remaining tasks of the branch pressure reducing valves involve compensating for changes in the pattern of load flow resistance among the loads and compensating for changes in system pressure accompanying the operation of the spool valves.

While operation of the branch and bypass pressure reducing valves are desirable under many circumstances to manage flow instabilities, both activation and deactivation of these valves can be controlled by the addition of control valves that can be operated to interfere with the sensing of setpoint conditions. For example, shut-off valves can be located in the sensing lines approaching the reservoir for developing back pressures that prevent the setpoint conditions of the pressure reducing valves from being achieved.

DRAWINGS

DETAILED DESCRIPTION

Figure 1:
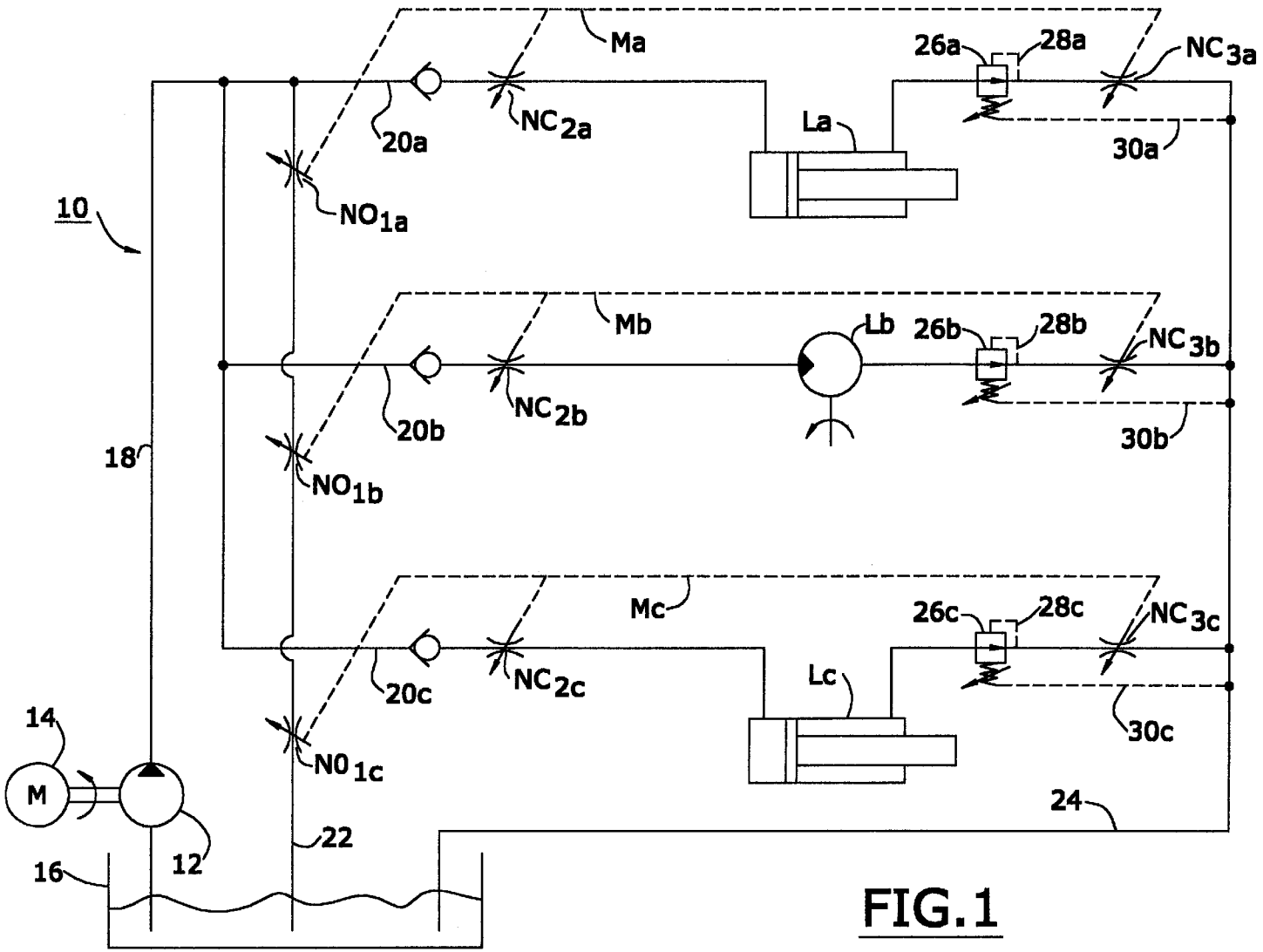
FIG. 1 is a circuit diagram of an open center hydraulic system containing branch pressure reducing valves to reduce flow instabilities in load branch lines. Directional control valves are depicted as three separately controllable orifices linked by a mechanical arm to more clearly represent their separate functions.

The open center hydraulic system 10 of FIG. 1 includes a fixed displacement pump 12 driven by a motor 14 for drawing fluid from a reservoir 16 and for pumping the fluid at a fixed rate along a common supply line 18 that splits into three load branches 20*a*, 20*b*, and 20*c*, as well as a common bypass line 22. Three normally open control orifices $NO_{1a}$, $NO_{1b}$, and $NO_{1c}$ interrupt the common bypass line 22 that returns fluid to the reservoir 16.

The normally open control orifices $NO_{1a}$, $NO_{1b}$, and $NO_{1c}$ are mechanically linked by control arms Ma, Mb, and Mc to respective pairs of normally closed control orifices $NC_{2a}$ and $NC_{3a}$, $NC_{2b}$ and $NC_{3b}$, and $NC_{2c}$, and $NC_{3c}$ that straddle respective loads La, Lb, and Lc. The loads La and Lc are depicted as hydraulic cylinders, and the load Lb is depicted as a hydraulic motor. Ordinarily, the one normally open control orifice (e.g., $NO_{1a}$) and the two normally closed orifices (e.g., $NC_{2a}$ and $NC_{3a}$) associated with each branch 20*a*, 20*b*, and 20*c* are incorporated into respective directional control valves, such as spool valves, but FIG. 1 depicts these control orifices as discrete components to better illustrate their individual functions.

Initially, all of the fixed rate flow from the pump 12 is returned to the reservoir along the bypass line 22. Little system pressure is developed to oppose the flow. However, adjusting any of the control arms Ma, Mb, and Mc to progressively close one of the normally open control orifices $NO_{1a}$, $NO_{1b}$, or $NO_{1c}$ resists the flow of fluid along the bypass line 22 and develops a system pressure reaching into the three branch lines 20*a*, 20*b*, and 20*c*. Further movement of the control arms Ma, Mb, or Mc progressively opens the normally closed control orifices $NC_{2a}$, $NC_{2b}$, or $NC_{2c}$ for releasing a portion of the flow to the loads La, Lb, or Lc. Movement of the loads La, Lb, or Lc enables fluid to reach the normally closed control orifices $NC_{3a}$, $NC_{3b}$, or $NC_{3c}$, which are progressively opened by yet further movement of the control arms Ma, Mb, or Mc for returning the fluid to the reservoir 16 along a common return line 24.

The normally closed control orifices $NC_{3a}$, $NC_{3b}$, and $NC_{3c}$ provide so-called "meter-out" functions for controlling the load speed. In prior designs, any one position of the control arms Ma, Mb, or Mc could result in a range of load speeds depending on the system pressure and the load resistance in the load branches 20*a*, 20*b*, and 20*c*. This flow instability can be corrected by positioning branch pressure reducing valves 26*a*, 26*b*, and 26*c* just upstream of the normally closed control orifices $NC_{3a}$, $NC_{3b}$, and $NC_{3c}$. Pairs of pressure sensing lines 28*a* and 30*a*, 28*b* and 30*b*, and 28*c* and 30*c* straddle the normally closed control orifices $NC_{3a}$, $NC_{3b}$, and $NC_{3c}$ to provide feedback pressures to the branch pressure reducing valves 26*a*, 26*b*, and 26*c*.

The branch pressure reducing valves 26*a*, 26*b*, and 26*c* are biased at setpoint differential pressures to maintain constant pressure differences across the normally closed control orifices $NC_{3a}$, $NC_{3b}$, and $NC_{3c}$. By eliminating variability in differential pressure across the normally closed control orifices $NC_{3a}$, $NC_{3b}$, and $NC_{3c}$, each different size opening of the normally closed control orifices $NC_{3a}$, $NC_{3b}$, and $NC_{3c}$ commands a specific flow rate through the normally closed control orifices $NC_{3a}$, $NC_{3b}$, and $NC_{3c}$ regardless of the system pressure upstream of the branch pressure reducing valves 26*a*, 26*b*, and 26*c*.

The proper setpoint for the differential pressure can be determined in comparison to its effect on the overall system pressure at the fixed displacement pump 12. In the no load condition (i.e., no load flow resistance), each load branch 20*a*, 20*b*, and 20*c* exhibits a characteristic system pressure profile throughout its range of operation (i.e., range of spool travel). Starting at neutral in a typical open center hydraulic system, the system pressure tends to increase with spool travel to a level pressure before decreasing to a minimum pressure approaching the end of spool travel. The setpoint differential pressure of the branch pressure reducing valves 26*a*, 26*b*, and 26*c* can be adjusted to only slightly raise the level or peak system pressure during a first portion of the spool travel, while having no affect on the minimum system pressure near the end of spool travel.

Alternatively, the setpoint differential pressure can be determined with a similar effect in comparison to the characteristic pressure drops that occur across the normally closed control orifices $NC_{3a}$, $NC_{3b}$, and $NC_{3c}$ throughout the range of spool travel. Typically, the pressure drop parallels the change in system pressure by rising to a level with increasing spool travel before falling off toward the end of spool travel. In this instance, the setpoint differential pressure is set at a differential pressure that is less than the maximum pressure drop within the range of spool travel but more than the minimum pressure drop associated with the end of spool travel. As a result, the branch pressure reducing valves 26*a*, 26*b*, and 26*c* permit the normally closed control orifices $NC_{3a}$, $NC_{3b}$, and $NC_{3c}$ to exhibit fine metering-out control over load speeds independent of system pressure fluctuations or load flow resistance throughout a range of load speeds without interfering with the maximum load speeds attainable by the system. The characteristic pressure profiles of the load branches can also be changed to take better advantage of the setpoint differential pressure controls, such as by modifying the opening and closing relationships among the normally open control orifice $NO_1$ and the two normally closed orifices $NC_2$ and $NC_3$ in each branch.

Figure 2:
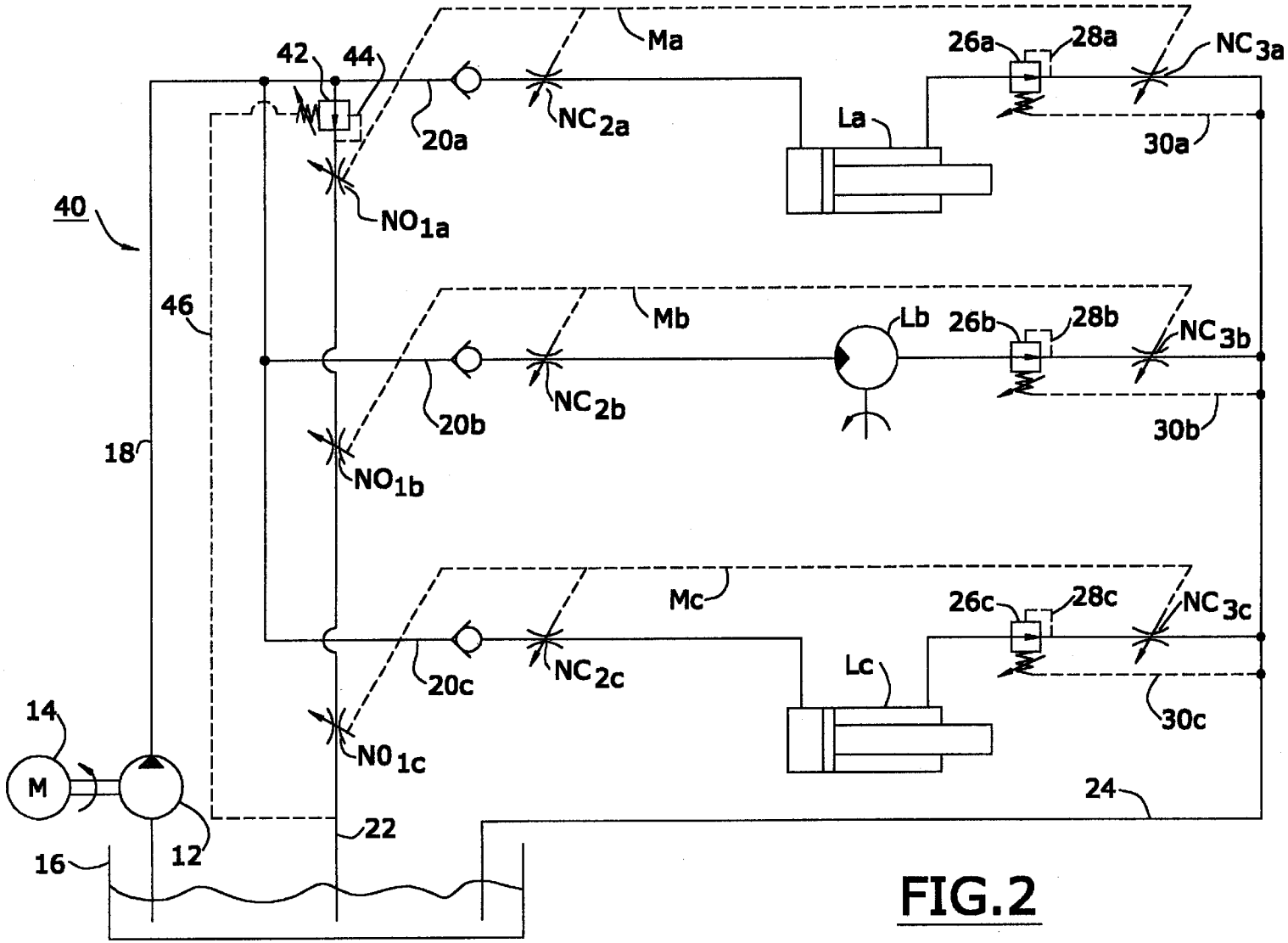
FIG. 2 is a similar diagram in which a bypass pressure reducing valve has been added to a bypass line for controlling a division of flow between the bypass line and the branch lines.

FIG. 2 depicts a similar open center hydraulic system 40. Components in common with the open center hydraulic system 10 are labeled with like reference numerals and will not be described further. The hydraulic system 40 differs by the addition of a bypass pressure reducing valve 42 that can be connected to the bypass line 22 upstream of the three normally open control orifices $NO_{1a}$, $NO_{1b}$, and $NO_{1c}$. Pressure sensing lines 44 and 46 communicate a differential pressure across all three normally open control orifices $NO_{1a}$, $NO_{1b}$ and $NO_{1c}$ to the bypass pressure reducing valve 42. Any differences between the sensed differential pressure and a setpoint differential pressure adjust the opening and closing of the bypass pressure reducing valve 42 to maintain a constant pressure drop across the three normally open control orifices $NO_{1a}$, $NO_{1b}$, and $NO_{1c}$.

At any one combination of spool position settings for the three normally open control orifices $NO_{1a}$, $NO_{1b}$, and $NO_{1c}$, the constant pressure drop commands a fixed amount of flow through the bypass line 22 to the reservoir 16. Since the output flow of the pump 12 is fixed, a fixed amount of remaining flow is also forced through the load branches 20*a*, 20*b*, and 20*c*. For example, an increase in the total flow resistance of the load branches 20*a*, 20*b*, and 20*c*, which would normally force a larger percentage of the flow through the bypass line 22 and reduce the combined flow through the load branches 20*a*, 20*b*, and 20*c*, is balanced by an additional restriction in the bypass line 22 to maintain the same distribution of flow between the bypass line 22 and the load branches 20*a*, 20*b*, and 20*c*.

The setpoint differential pressure of the bypass pressure reducing valve 42 is preferably set in relation to the characteristic pressure profile of the system to cover a range of normal operations. Set too low, the bypass pressure reducing valve 42 wastes energy. Set too high, the bypass pressure reducing valve 42 has too little effect on flows through the bypass line 22.

Overall system performance can be enhanced by using the bypass pressure reducing valve 42 in combination with the branch pressure reducing valves 26*a*, 26*b*, and 26*c*. The bypass pressure reducing valve 42 provides a steady flow of fluid to the load branches 20*a*, 20*b*, and 20*c* despite variations in the total flow resistance of the load branches 20*a*, 20*b*, and 20*c*. This assures that the branch pressure reducing valves 26*a*, 26*b*, and 26*c* receive sufficient flow for carrying out their intended functions during momentary increases in the total load flow resistance. Though to a lesser extent, the bypass pressure reducing valve 42 can also reduce excess flow to the load branches 20*a*, 20*b*, and 20*c* caused by momentary decreases in the total load flow resistance. This reduces the work required of the branch pressure reducing valves 26*a*, 26*b*, and 26*c*, which are more suited for restricting the excess flow.

Figure 3:
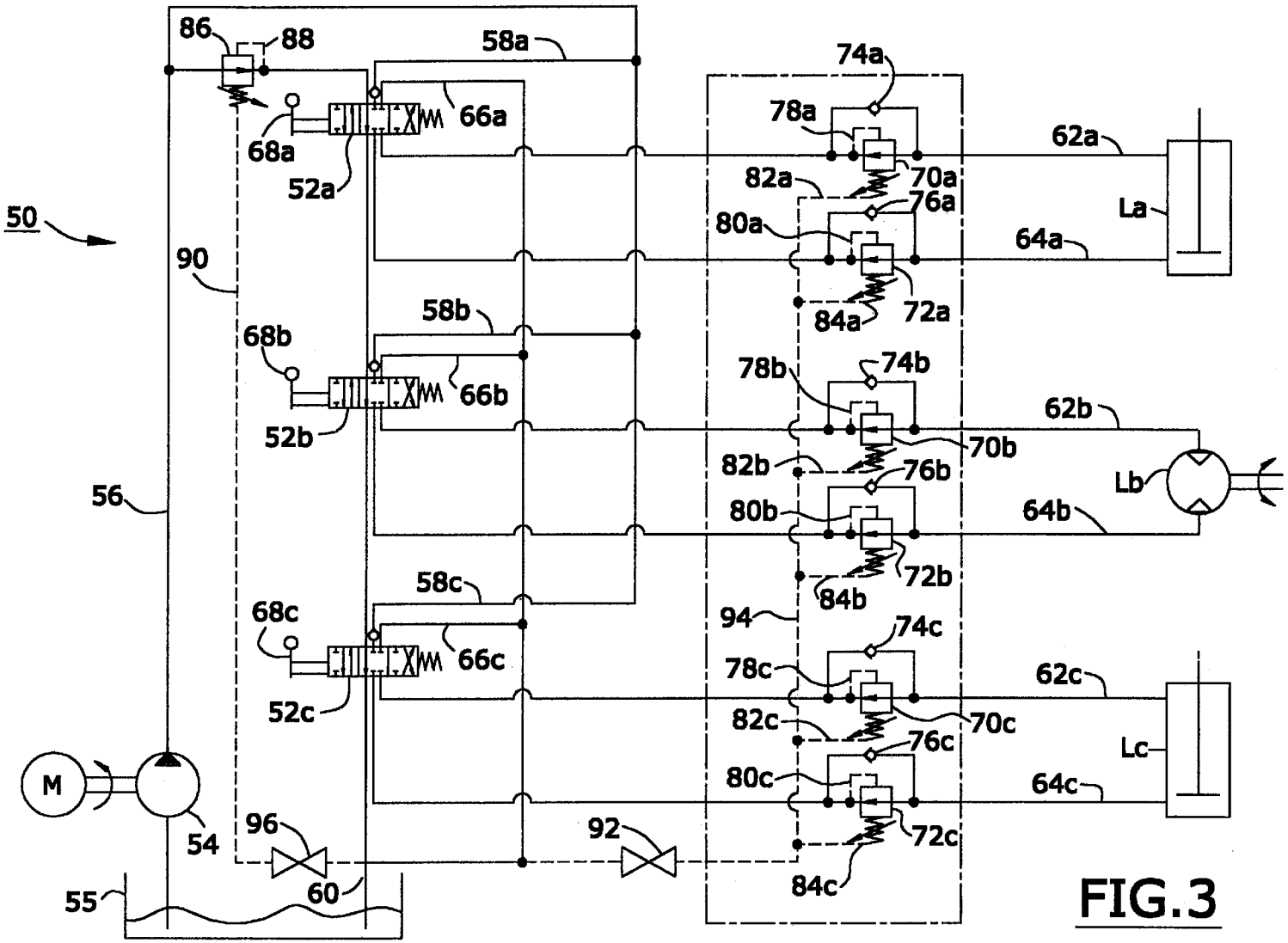
FIG. 3 is a circuit diagram of an alternative open center hydraulic system containing both bypass and branch pressure reducing valves. Conventional symbols are used to represent the directional control valves, which control forward and reverse directions of flow through the loads.

Another open center hydraulic system 50 is depicted by FIG. 3 in a more conventional format. Directional control valves 52*a*, 52*b*, and 52*c*, which are preferably spool valves, replace the combination of one normally open control orifice $NO_1$ and two pairs of normally closed control orifices $NC_2$, $NC_3$ and $NC_4$, $NC_5$. In addition, as implied by the two pairs of normally closed orifices, the hydraulic system 50 supports opposite directions of load control.

Flow proceeds from a fixed displacement pump 54 along a common supply line 56 that splits into three branch supply lines 58*a*, 58*b*, and 58*c* and a bypass line 60 that returns flow to a reservoir 55. The bank of directional control valves 52*a*, 52*b*, and 52*c* are supplied in series along the bypass line 60 and are supplied in parallel by the three branch supply lines 58*a*, 58*b*, and 58*c*. Two working/exhaust lines 62*a* and 64*a*, 62*b* and 64*b*, and 62*c* and 64*c* are connected to different ports of the directional control valves 52*a*, 52*b*, and 52*c* to carry fluid in opposite directions to and from loads La, Lb, and Lc. Return lines 66*a*, 66*b*, and 66*c* from the directional control valves 52*a*, 52*b*, and 52*c* are combined to provide an alternative path to the reservoir 55.

Movement of directional control valve actuators (e.g., valve handles) 68*a*, 68*b*, or 68*c* in one direction from a neutral starting point closes off normally open flow along the bypass line 60 and produces a working pressure in the working/exhaust lines 62*a*, 62*b*, or 62*c* for moving the loads La, Lb, or Lc. Exhaust flow from the loads La, Lb, or Lc is returned to the directional control valves 52*a*, 52*b*, and 52*c* along the working/exhaust lines 64*a*, 64*b*, or 64*c*. After metering by the instant position of the directional control valves 52*a*, 52*b*, and 52*c*, the exhaust flow is returned to the reservoir 55 along the return lines 66*a*, 66*b*, or 66*c*. Movement of directional control valve actuators (e.g., valve handles) 68*a*, 68*b*, or 68*c* in the opposite direction from the neutral starting point generates a similar flow pattern except that the working/exhaust lines 64*a*, 64*b*, or 64*c* convey flows to the loads La, Lb, or Lc and the working/exhaust lines 62*a*, 62*b*, or 62*c* return flows to the directional control valves 52*a*, 52*b*, and 52*c*.

Both the working/exhaust lines 62*a*, 62*b*, or 62*c* and the working/exhaust lines 64*a*, 64*b*, or 64*c* are interrupted by branch pressure reducing valves 70*a* and 72*a*, 70*b* and 72*b*, and 70*c* and 72*c*. However, each of the branch pressure reducing valves 70*a* and 72*a*, 70*b* and 72*b*, and 70*c* and 72*c* is associated with a check valve bypass 74*a* and 76*a*, 74*b* and 76*b*, and 74*c* and 76*c* to bypass flows from the directional control valves 52*a*, 52*b*, and 52*c* through the otherwise impeding branch pressure reducing valves 70*a* or 72*a*, 70*b* or 72*b*, and 70*c* or 72*c*. As a result, the branch pressure reducing valves 70*a* and 72*a*, 70*b* and 72*b*, and 70*c* and 72*c* only restrict exhaust flows from the loads La, Lb, and Lc to the directional control valves 52*a*, 52*b*, and 52*c*.

Differential pressure across the meter-out function of the directional control valves 52*a*, 52*b*, and 52*c* can be monitored by each of the branch pressure reducing valves 70*a* and 72*a*, 70*b* and 72*b*, and 70*c* and 72*c* through exhaust flow sensing lines 78*a* or 80*a*, 78*b* or 80*b*, and 78*c* or 80*c* in combination with return flow sensing lines 82*a* or 84*a*, 82*b* or 84*b*, and 82*c* or 84*c*. The setpoint differential pressures for the branch pressure reducing valves 70*a* and 72*a*, 70*b* and 72*b*, and 70*c* and 72*c* are preferably set as described above to provide fine metering-out control over load speeds independent of system pressure fluctuations or load flow resistance throughout an initial range of load speeds without interfering with the maximum load speeds attainable by the system.

A bypass pressure reducing valve 86 is positioned along the bypass line 60 upstream of the three directional control valves 52*a*, 52*b*, and 52*c*. Sensing lines 88 and 90 monitor the differential pressure across the three directional control valves 52*a*, 52*b*, and 52*c* and, in combination with a predetermined bias, control operation of the bypass pressure reducing valve 86 to restrict excess flow through the bypass line 60. The bypass pressure reducing valve 86 maintains a setpoint differential pressure across the three directional control valves 52*a*, 52*b*, and 52*c* to preserve a fixed flow distribution between the bypass line 60 and the three branch supply lines 58*a*, 58*b*, and 58*c* despite load flow resistance variations. Each different position combination of the control valve actuators 68*a*, 68*b*, and 68*c* within the working range of the bypass pressure reducing valve 86 supports a different total flow rate through the three branch supply lines 58*a*, 58*b*, and 58*c* independent of variations in the total load flow resistance of the branch lines.

The setpoint differential pressure of the bypass pressure reducing valve 86 is preferably set to balance tradeoffs between flow stability and efficiency in accordance with the characteristic pressure profile of the hydraulic system 50 and its expected range of use. However, some systems, which are modified to include the meter-out pressure compensation provided by the branch pressure reducing valves 70*a–c* and 72*a–c*, may not require the bypass pressure reducing valve 86 to achieve sufficient flow control.

Either or both the branch pressure reducing valves 70*a–c* and 72*a–c* and the bypass pressure reducing valve 86 can be deactivated to save energy when improved control over load speed is not needed. A shut-off valve 92 is located along a common portion 94 of return flow sensing lines 82*a–c* and 84*a–c* and can be closed to develop a back pressure in the return flow sensing lines that prevents the differential setpoint conditions from being achieved to close any of the branch pressure reducing valves 70*a–c* and 72*a–c*. The back pressure is developed because of small leakages from the branch pressure reducing valves 70*a–c* and 72*a–c* through the return flow sensing lines 82*a–c* and 84*a–c*. Reopening the shut-off valve 92 releases the accumulated leakage to the reservoir 55 and permits the branch pressure reducing valves 70*a–c* and 72*a–c* to operate normally.

A shut-off valve 96 interrupts the sensing line 90 from the bypass pressure reducing valve 86. Closing this valve 96 has a similar effect of preventing the setpoint conditions for operation of the bypass pressure reducing valve 86 from being achieved regardless of the actual differential pressure across the three directional control valves 52*a*, 52*b*, and 52*c*.

Alternatively, separate shut-off valves could be associated with the two operating directions of each of the directional control valves 52*a*, 52*b*, and 52*c*. For example, separate shut-off valves could be located in each of the return flow sensing lines 82*a–c* and 84*a–c* for separately deactivating any one of the branch pressure reducing valves 70*a–c* and 72*a–c*.

A control system could also be used to statically or dynamically adjust the setpoint differential pressures of the branch pressure reducing valves 70*a–c* and 72*a–c* to vary the meter-out control between load branches or between different operating demands. For example, the setpoint differential pressures can be temporarily reduced at a cost of efficiency and overall speed to provide more control over a limited range of load speeds. The ratio of actuator movement to speed variation can be enlarged by reducing the setpoint differential pressure. On the other hand, the control system could also be used to reduce or eliminate the effects of one or more of the branch pressure reducing valves 70*a–c* and 72*a–c* (such as by controlling the shut-off valve 92). The control system could also be used to adjust the setpoint differential pressure of the bypass pressure reducing valve to better match either ongoing or anticipated operating conditions.

Applicability

My invention is particularly intended as an improvement to backhoes and other excavators that include open center hydraulic systems, but also has wide applicability throughout the field of mobile hydraulics as well as to stationary open center hydraulic systems requiring improved flow stability between load branches.

I claim:

1. An open center fluid system comprising:

a fluid power source having a low-pressure side and a high-pressure side;

at least two load control valves connecting different loads to the opposite sides of the fluid power source;

each of the valves having a restrictable center passage connected in series with the restrictable center passages of one or more other of the valves;

each of the valves having a restrictable exhaust passage connected in parallel with restrictable exhaust passages of the one or more other valves and connected in series with one of the loads between the loads and the low-pressure side of the fluid power source; and pressure responsive valves located between the loads and the restrictable exhaust passages for limiting pressure drops across the restrictable exhaust passages for reducing interactions between the loads.

2. The system of claim 1 in which the pressure responsive valves include first pressure sensing lines that sense pressure between the loads and the restrictable exhaust passages and second pressure lines that sense pressure between the restrictable exhaust passages and the low-pressure side of the fluid power source.

3. The system of claim 2 in which the pressure responsive valves restrict flow to the restrictable exhaust passages above a predetermined differential pressure sensed between the first and second pressure sensing lines.

4. The system of claim 3 further comprising a control valve interrupting one of the pressure sensing lines for affecting operation of at least one of the pressure responsive valves.

5. The system of claim 4 in which the control valve is actuatable for preventing at least one of the pressure responsive valves from restricting flow to at least one of the restrictable exhaust passages.

6. The system of claim 5 in which the control valve is a shut-off valve interrupting at least one of the second pressure sensing lines.

7. The system of claim 1 further comprising an additional pressure responsive valve located between the fluid power source and the restrictable center passages for limiting pressure drops across the restrictable center passages to maintain adequate flows of fluid to the loads.

8. The system of claim 7 in which the additional pressure responsive valve includes a first additional pressure sensing line that senses pressure between the high-pressure side of the fluid power source and the restrictable center passages and a second pressure line that senses pressure between the restrictable center passages and the low-pressure side of the fluid power source.

9. The system of claim 1 in which each of the load control valves also has a restrictable power passage connected in parallel with restrictable power passages of the one or more other load control valves and connected in series with one of the loads between the high-pressure side of the fluid power source and the loads.

10. The system of claim 9 in which the restrictable center passage is open while the restrictable power and exhaust passages are closed to prevent fluid flows through the loads.

11. The system of claim 10 in which each of the load control valves includes an actuator that progressively closes the restrictable center passage while progressively opening the restrictable power and exhaust passages to direct fluid flows through individual loads.

12. A meter-out pressure compensating system of an open center valve assembly having a center orifice, a power orifice, and an exhaust orifice interconnected by an actuator that progressively closes the center orifice while progressively opening the power and exhaust orifices for regulating fluid flows to a load straddled by the power and exhaust orifices in which the exhaust orifice is pressure compensated to limit effects of pressure variations on flow rates metered through the exhaust orifice.

13. The system of claim 12 in which an adjustable flow restrict or is connected between the load and the exhaust orifice to restrict fluid flows through the exhaust orifice.

14. The system of claim 13 in which the adjustable flow restrict or is arranged to restrict flows through the exhaust orifice in response to a measure of differential pressure across the exhaust orifice.

15. The system of claim 14 in which the adjustable flow restrict or is controlled to restrict flow amounts through the exhaust orifice to maintain a setpoint differential pressure across the exhaust orifice.

16. The system of claim 14 in which a pressure sensor senses differential pressure across the exhaust orifice and the adjustable flow restrictor is responsive to the sensed differential pressure above a predetermined pressure by restricting flows through the exhaust orifice.

17. The system of claim 13 in which a shut-off can be activated to prevent the adjustable flow restrictor from restricting flows through the exhaust orifice.

18. The system of claim 17 in which a pressure sensor senses differential pressure across the exhaust orifice for regulating operation of the adjustable flow restrictor and the shut-off can be activated to interfere with operation of the pressure sensor.

19. An open center fluid system comprising:

a fluid power source having a low-pressure side and a high-pressure side;

at least two load control valves connecting different loads to the opposite sides of the fluid power source;

each of the valves having a restrictable center passage connected in series with the restrictable center passages of one or more other of the valves;

each of the valves having a restrictable power passage connected in parallel with restrictable power passages of the one or more other valves and connected in series with one of the loads between the high-pressure side of the fluid power source and the loads;

each of the valves having a restrictable exhaust passage connected in parallel with restrictable exhaust passages of the one or more other valves and connected in series with one of the loads between the loads and the low-pressure side of the fluid power source;

an actuator that progressively closes the restrictable center passage while progressively opening the restrictable power and exhaust passages to direct fluid flows through individual loads;

a pressure responsive valve that limits pressure drops across one of the restrictable passages for reducing interactions between the loads; and a control valve that is actuatable for preventing the pressure responsive valve from limiting pressure drops across the one restrictable passage.

20. The system of claim 19 in which the pressure responsive valve is arranged to restrict flows through the one restrictable passage orifice in response to a measure of differential pressure across the restrictable passage.

21. The system of claim 20 in which a pressure sensor senses differential pressure across the one restrictable passage and the pressure responsive valve is responsive to the sensed differential pressure above a predetermined pressure by restricting flows through the one restrictable passage.

22. The system of claim 21 in which the control valve is actuatable to interfere with operation of the pressure sensor.

23. The system of claim 22 in which the pressure sensor includes two sensing lines connected to opposite sides of the one restrictable passage and the control valve is a shut off valve located along one of the sensing lines between the one restrictable passage and the low-pressure side of the fluid power source.

24. The system of claim 19 in which the one restrictable passage is the restrictable exhaust passage.

25. The system of claim 19 in which the one restrictable passage is the restrictable center passage.

26. The system of claim 19 in which the pressure responsive valve is one of first and second pressure responsive valves, the first pressure responsive valve limiting pressure drops across at least one of the restrictable center passages and the second pressure responsive valve limiting pressure drops across at least one of the restrictable exhaust passages.

27. The system of claim 26 in which the control valve is one of first and second control valves, the first control valve being actuatable for preventing the first pressure responsive valve from limiting pressure drops across the at least one restrictable center passage and the second control valve being actuatable for preventing he second pressure responsive valve from limiting pressure drops cross the at least one restrictable exhaust passage.

28. A method of assembling an open center fluid system having open center valves regulating flows to loads located along branches for reducing interactions between branches comprising the steps of:

arranging restrictable center passages of the valves in series along a bypass line connecting high-pressure and low-pressure sides of a fluid power source;

arranging restrictable power and exhaust passages straddling the loads along branch lines which also connect the opposite sides of the fluid power source;

locating adjustable flow restrictors between the loads and the restrictable exhaust passages;

connecting sensors for monitoring differential pressures across the restrictable exhaust passages; and relating the sensors to the adjustable flow restrictors to restrict flows to the restrictable exhaust passages in response to monitored differential pressures across the restrictable exhaust passages.

29. The method of claim 28 in which the step of relating includes a provision for restricting flows to the restrictable exhaust passages in response to monitored differential pressures above predetermined differential pressures.

30. The method of claim 28 in which said step of relating includes a provision for restricting flows to the restrictable exhaust passages to maintain predetermined differential pressures across the restrictable exhaust passages.

31. The method of claim 28 in which the step of connecting includes connecting first pressure sensing lines for sensing pressures between the loads and the restrictable exhaust passages and connecting second pressure lines for sensing pressure between the restrictable exhaust passages and the low-pressure side of the fluid power source.

32. The method of claim 28 including a further step of locating an adjustable bypass flow restrictor between the high-pressure side of the fluid power source and the restrictable center passages.

33. The method of claim 32 including a further step of connecting a bypass sensor for monitoring differential pressure across the restrictable center passages.

34. The method of claim 33 including a further step of relating the bypass sensor to the adjustable bypass flow restrictor to restrict flows to the restrictable center passages in response to monitored differential pressures across the restrictable center passages.

35. The method of claim 28 including a further step of positioning a control valve for interacting with the sensors for activating and deactivating the adjustable flow restrictors.

36. An open center hydraulic system comprising:

a fixed displacement pump that draws fluid from a reservoir and pumps the fluid along a supply line;

a directional control valve having a normally open orifice and first and second normally closed orifices;

both said normally open orifice and said first normally closed orifices being connected to said supply line;

a bypass line that connects said normally open orifice to the reservoir;

a working line that connects said first normally closed orifice to a load;

an exhaust line that connects the load to said second normally closed orifice;

a return line that connects said second normally closed orifice to the reservoir;

an actuator for closing said normally open orifice and opening said two normally closed orifices; and a pressure reducing valve that restricts flow along said exhaust line to maintain a predetermined differential pressure across said second normally closed orifice.

* * * * *